United States Patent [19]

Tanaka et al.

[11] 4,192,357

[45] Mar. 11, 1980

[54] WEFT YARN GRASPING APPARATUS FOR FLUID JET LOOM

[75] Inventors: Shigenori Tanaka, Hachioji; Akio Tojo, Higashi-murayama; Kimimasa Ohnishi, Tokyo; Takeshi Kikuchi, Chofu, allof, Japan

[73] Assignee: Nissan Motor Company, Limited, Japan

[21] Appl. No.: 836,958

[22] Filed: Sep. 27, 1977

[30] Foreign Application Priority Data

Dec. 27, 1976 [JP] Japan ..... 51-157739

[51] Int. Cl.[2] ..... D03D 47/34

[52] U.S. Cl. ..... 139/450; 139/435; 139/429; 112/155

[58] Field of Search ..... 139/194, 429, 435, 450, 139/452; 112/DIG. 3, 154, 155; 242/150

[56] References Cited

U.S. PATENT DOCUMENTS

| | | | |
|---|---|---|---|
| 2,819,736 | 1/1958 | Pfarrwaller | 139/450 |
| 2,965,058 | 12/1960 | Herbst et al. | 242/150 |
| 3,181,569 | 5/1965 | Carroll | 139/450 |
| 3,482,606 | 12/1969 | Mizuno et al. | 139/452 |
| 3,820,574 | 6/1974 | Mizuno | 139/435 |

FOREIGN PATENT DOCUMENTS

| | | | |
|---|---|---|---|
| 47-51986 | 12/1972 | Japan | 139/450 |

*Primary Examiner*—Henry Jaudon

*Attorney, Agent, or Firm*—Robert E. Burns; Emmanuel J. Lobato; Bruce L. Adams

[57] ABSTRACT

The weft yarn is selectively gripped and released by movable and stationary disc members in response to the weaving operation of the loom. The gripping force applied to the weft yarn by the members is such controlled that under beating of the reed, the magnitude of the force is decreased by a predetermined value thereby inducing a slippage of the weft yarn in the members.

9 Claims, 9 Drawing Figures

WEFT YARN GRASPING APPARATUS FOR FLUID JET LOOM

BACKGROUND OF THE INVENTION

The present invention relates in general to a fluid jet weaving loom, such as water jet loom and/or air jet loom, and more particularly to a weft yarn grasping apparatus functioning to selectively grasp and release the weft yarn which is picked into the shed of the warp yarns by the aid of fluid jet stream in response to the weaving operation of the loom.

SUMMARY OF THE INVENTION

It is an object of the present invention to provide an improved weft yarn grasping apparatus for a fluid jet weaving loom, the apparatus contributing substantially to production of fabric of good quality.

It is another object of the present invention to provide an improved weft yarn grasping apparatus the gripping force of which is such controlled that under beating up of the reed, the magnitude of the gripping force is decreased by a predetermined value thereby inducting a slippage of the weft yarn by the apparatus, so that the undesirable weft yarn breakage which has been caused by an application of an abnormally big tension to the weft yarn under beating is eliminated.

It is still another object of the present invention to provide an improved weft yarn grasping apparatus the operation of which does not cause an abnormally big tension to the weft yarn under beating is eliminated.

It is a further object of the invention to provide an improved weft yarn grasping apparatus which is produced by slightly modifying the conventional weft yarn grasping apparatus.

BRIEF DESCRIPTION OF THE DRAWINGS

Other objects and advantages of the present invention will become apparent from the following detailed description when taken in conjunction with the accompanying drawings, in which.

DESCRIPTION OF THE PREFERRED EMBODIMENTS

Prior to explaining the construction of the grasping apparatus of the subject invention, a description of the conventional grasping apparatus will be given with the aid of FIGS. 1 and 2 in order to clarify the inventive steps of the invention.

Figure 1:
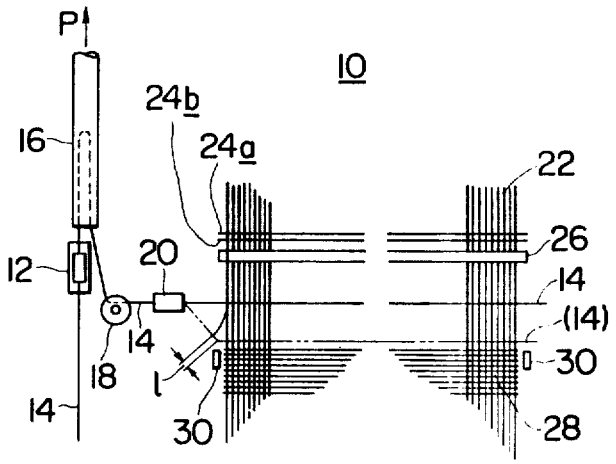
FIG. 1 is a partial, schematic view of a conventional fluid jet weaving loom.

Referring to FIG. 1 of the drawing, there is schematically illustrated a conventional fluid jet weaving loom which is generally designated by numeral 10. The loom 10 comprises a weft yarn measuring device 12 by which a predetermined length of weft yarn 14 is withdrawn from a weft yarn supplier (not shown). A weft yarn storage tube 16 is arranged to receive therein the predetermined length of the weft yarn 14 by the aid of air stream flowing in the illustrated direction P. Denoted by numeral 18 is a weft yarn grasping apparatus which functions to selectively grasp and release the weft yarn 14 coming from the storage tube 16. A fluid jet nozzle 20, such as air jet nozzle and water jet nozzle, receives therein the weft yarn 14 from the grasping apparatus 18 for throwing the same into a shed (no numeral) of longitudinally parallelly arranged warp yarns 22, the shed being formed by heddles **24*a* and 24*b*. A reed 26 is perpendicularly arranged on the warp yarns 22 to beat up the weft yarn 14 just thrown into the shed for the nozzle 20 thereby to form a fabric 28. Designated by numerals 30 are heat cutters which cut end sections of the penetrated weft yarn 14 after the beating of the reed 26**.

Figure 2:
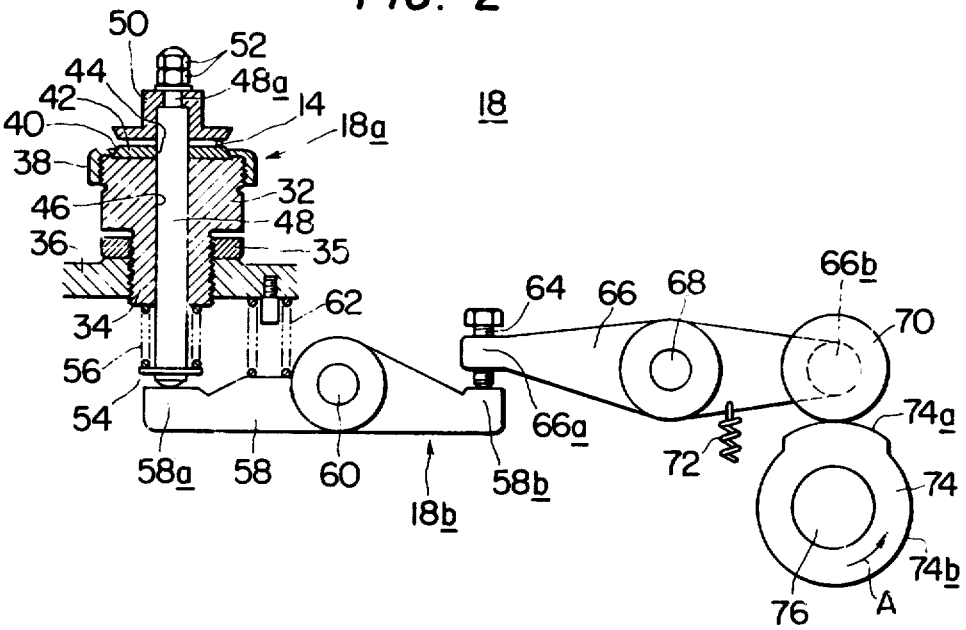
FIG. 2 is an enlarged sectional view of a conventional weft yarn grasping apparatus employed in the loom of FIG. 1.

In FIG. 2, a detailed construction of the conventional weft yarn grasping apparatus 18 is shown in a sectional manner. The apparatus 18 generally comprises a gripping device **18*a* and an actuating device 18*b***.

The gripping device **18*a* comprises a cylindrical base member 32 which has at its lower section an extension 34 threaded via a connecting nut 35 in an opening (no numeral) formed in a frame member 36 of the loom 10 and at its upper section an exteriorly threaded portion (no numeral). Screwed and fixed to the threaded portion is a holding ring 38 which has a central opening 40 through which a stationary disc member 42 is tightly attached on an upper portion of the base member 32. The stationary disc member 42 and the base member 32 are respectively formed with a central opening 44 and a central passage 46 which are vertically aligned to each other to slidably receive therein a reciprocating rod 48. The rod 48 is equipped at its upper end, projected from the stationary disc member 42, with a cup-shaped disc member 50 via connecting nuts 52 screwed to a threaded extension 48*a* of the rod 48. Hereinafter, the cup-shaped disc member 50 will be referred as a movable disc member for facilitation of the description. The movable disc member 50 has a flat lower surface portion (no numeral) which faces to a flat upper surface portion (no numeral) of the stationary disc member 42. Between the flat surface portions of the movable and stationary disc members 50 and 42 is inserted the weft yarn 14 which is fed from the weft yarn storage tube 16 (FIG. 1). As shown, the rod 48 is equipped at its lower end section, projected from the base member extension 34, with a retainer 54 for disposing a compression spring 56 between it and the extension 34 to urge the reciprocating rod 48 downwardly, that is in a direction to move the movable disc member 50 toward the stationary disc member 42 thus grasping the weft yarn 14**.

For intermittently pushing up the rod 48 and thus the movable disc member 50 to release the weft yarn 14, the actuating device 18*b* is employed, which comprises a first lever 58 pivotally supported at its fulcrum 60. The first lever 58 has a left end 58*a* contactable with a convex surface formed on the downwardly extending end of the reciprocating rod 48. A spring 62 is disposed between the left side of the lever 58 and the frame member 36 to urge the lever in a counterclockwise direction. The first lever 58 has a right end 58*b* which is contactable with a lower end of an adjusting screw 64 fixed to a second lever 66. The second lever 66 is pivotally supported at its fulcrum 68 and has a left end 66*a* to which the adjusting screw 64 is fixed and a right end 66*b* to which a cam follower 70 is rotatably fixed. A tension spring 72 is fixed to the right side of the second lever 66 for biasing the same to rotate in a clockwise direction forcing the cam follower 70 to operatively engage with a cam 74 which is tightly disposed about an axis 76. The axis 76 is arranged to rotate one time per one pcking action of the loom 10, in a counterclockwise direction as indicated by an arrow A. The cam 74 has thereon a projected cam surface 74*a* and a non-projected cam surface 74*b*, as shown.

With this, in operation, when the cam follower 70 rises on the projected cam surface 74*a* of the cam 74, as hereinillustrated, the second lever 66 takes a position to allow the first lever 58 to push upwardly the reciprocating rod 48 and thus the movable disc member 50 to release the weft yarn 14 from the gripping device 18*a*, while when the cam follower 70 slides on the non-projected cam surface 74*b* of the cam 74, the second lever 66 takes the other position to allow the first lever 58 to swing in a counterclockwise direction by the action of the springs 56 and 62 allowing the reciprocating rod 48 and thus the movable disc member 50 to move toward or return to its home position by the action of the spring 56 to grip the weft yarn 14.

However, in the fluid jet loom equipped with the above-mentioned type weft yarn grasping apparatus 18, there arises such a severe problem that a remarkably high tension is inevitably applied to the weft yarn 14 under beating up of the reed 26 thereby causing snapping of the weft yarn and occurrence of crucks in the weft yarn 14. This is because when the reed 26 is carried from its rest position to the beating position, the weft yarn 14 having been just inserted into the shed of the warp yarns 22 is forced to stretch by a certain length "l" as is shown in FIG. 1. In fact, this type grasping apparatus 18 is constructed to tightly grip the weft yarn 14 without permitting a bit of the same to slip out therefrom while the reed 26 operates to beat up the weft yarn 14.

Japanese Patent Provisional Publication referenced by TOKKOSHO No. 47-51986 discloses a weft yarn grasping apparatus which can partially solve the above-mentioned drawback. The grasping apparatus of this Publication is constructed to completely release the weft yarn under the beating of the reed. However, in this disclosed apparatus, there arises further problem in which the weft yarns penetrated into the warp yarns in every picking actions are remarkably changed in length and the tension given to each weft yarn becomes too low to make a good fabric.

Thus, as described hereinbefore, the present invention contemplates the elimination of the above-stated several drawbacks encountered in the conventional weft yarn grasping apparatus.

Figure 3:
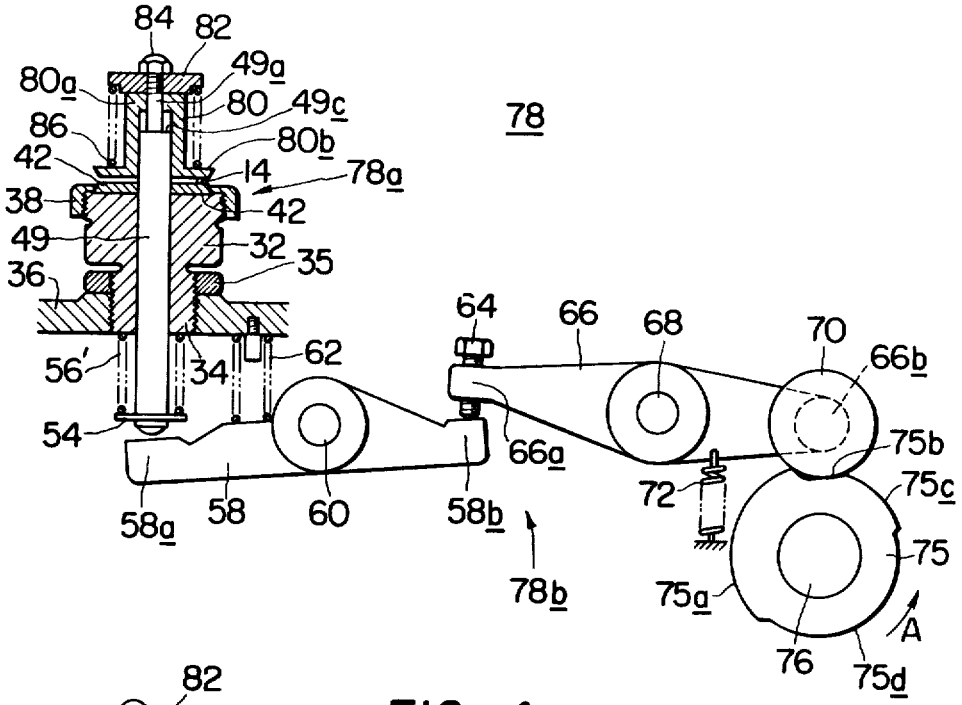
FIG. 3 is a view similar to FIG. 2, but showing a first preferred embodiment of the present invention.

Reference is now made to FIG. 3, there is illustrated an improved weft yarn grasping apparatus of the first preferred embodiment according to the invention, the apparatus being generally designated by numeral 78. The grasping apparatus 78 of this embodiment generally comprises a weft yarn gripping device 78*a* and an actuating device 78*b* which are somewhat similar in construction to the devices 18*a* and 18*b* of the above-mentioned conventional apparatus 18 of FIG. 2. Thus, substantially same or similar parts are designated by the same numerals as in the case of FIG. 2.

The gripping device 78*a* includes a reciprocating rod 49 having at its upper end 49*c* a small diameter extension 49*a* the length of which is sufficiently greater than that of the extension 48*a* of the conventional gripping device 18*a* mentioned above. The extension 49*a* slidably passes through an opening (no numeral) formed in a base section 80*a* of a cup-shaped disc member 80 and then connects at its top end to a stop member 82 via a connecting nut 74. The cup-shaped disc member 80, similar to the before-mentioned movable disc member 50 of FIG. 2, has a flat lower surface or .flange portion 80*b* which faces to the flat upper surface portion of the stationary disc member 42. It should be noted that the cup-shaped disc member 80 is permitted to slide along the extension 49*a* between the stop member 82 and the upper end 49*c* of the rod 49 from which the extension 49*a* protrudes. Thus, hereinafter, the cup-shaped disc member 80 will be referred as a movable disc member. A compression spring 86 is concentrically disposed around the movable disc member 80 between the stop member 82 and the flange portion 80*b* of the movable disc member 80 so that the movavle disc member 80 is biased downwardly that is in a direction toward the stationary disc member 42. Now, it is also to be noted that the biasing force produced by the spring 86 is set sufficiently smaller than that of the spring 56' disposed between the retainer 54 fixed to the rod 49 and the lower extension 34 of the base member 32. Thus, when the reciprocating rod 49 is not given as upwardly biasing force by the first lever 58, the rod 49 locates at its lower most position with a result that the stop member 82 tightly abuts on the base section 80*a* of the movable disc member 80 strongly urging the same toward the stationary disc member 42. Under this state, the weft yarn 14 is tightly or strongly gripped by the gripping device 78*a*. While, when the rod 49 is lifted upwardly a slight distance by the first lever 58, the stop member 82 is separated from the movable disc member 80 while keeping the same at its previously set position with the aid of the spring 86, as will be understood from FIG. 5. Under this state, the gripping force applied to the weft yarn 14 by the gripping device 78*a* is somewhat reduced to such a value that the sandwiched weft yarn 14 is caused to slipperily slide in the gripping device 78*a* when it is pulled by a predetermined magnitude of force in its travelling direction. Furthermore, when the rod 49 is lifted up more by the first lever 58 the upper end 49*c* of the rod proper 49 is brought into contact with the inner surface of the base section 80*a* of the movable disc member 80 and finally, the movable disc member 80 is lifted to a position to define a large clearance between the movable disc member 80 and the stationary disc member 42, as will be well understood from FIG. 4. Under this state, the weft yarn 14 is completely released from the gripping device 78*a*.

As shown in FIG. 3, the actuating device 78*b* of the first preferred embodiment comprises generally same parts as in the conventional one 18*b* of FIG. 2 except for a cam 75 fixed to the axis 76. The cam 75 is formed to have first and second projected cam surfaces 75*a* and 75*c* and first and second non-projected cam surfaces 75*b* and 75*d*, the projected cam surfaces and the non-projected cam surfaces being arranged alternatively as shown. It should be noted that the height of the first projected cam surface 75*a* is sufficiently greater than that of the second projected one 75*c* and is substantially same as the projected cam surface 74*a* of the before-mentioned conventional cam 74 of FIG. 2.

Figure 4:
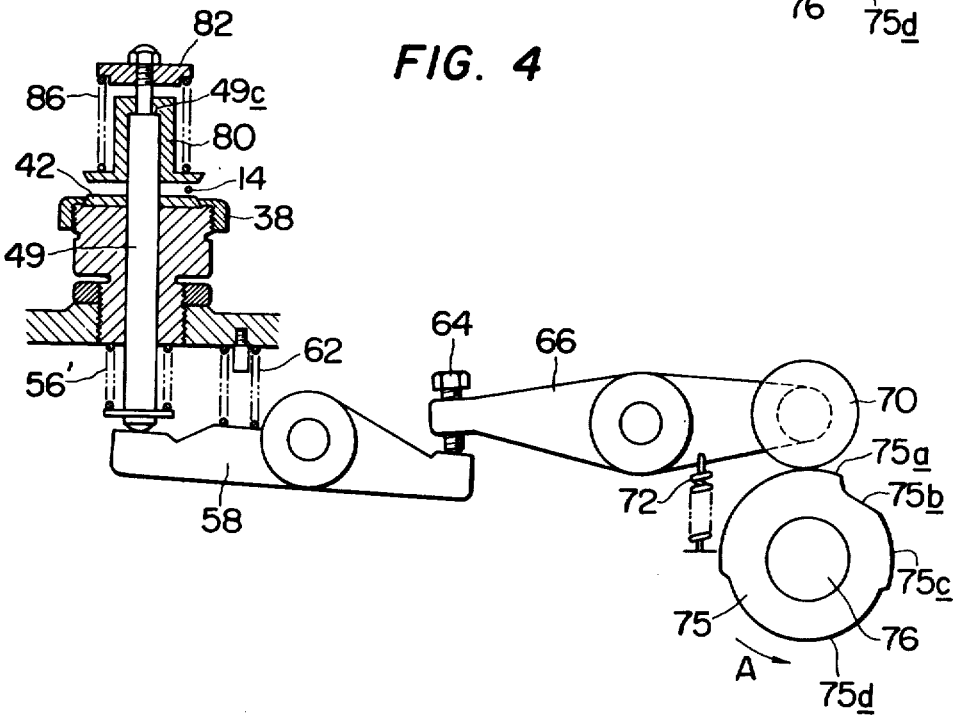
FIGS. 4 and 5 are views respectively showing other operating conditions of the first preferred embodiment.

With this construction of the grasping apparatus 78, the operation of it is as follows:

For facilitation, the explanation of the operation will be given with the aid of FIG. 1. When picking or insertion of the weft yarn 14 into the shed of the warp yarns 22 is taken, the cam 75 takes a position in which the first projected cam surface 75*a* engages the cam follower 70 as seen in FIG. 4. The engagement of the cam surface 75*a* with the follower 70 induces a state in which the first lever pushes up the reciprocating rod 49 to its uppermost position with a result that the movable disc member 80 is lifted up to completely release the weft yarn 14 from the gripping device 78*a*. Thus, the weft yarn picking is surely achieved.

After the weft yarn insertion, the cam 75 is rotated to take a position wherein the non-projected cam surface 75*b* engages the cam follower 70 as seen in FIG. 3. During this, the first lever 58 swings in a counterclockwise direction by action of the springs 56 and 62 in response to the clockwise swing of the second lever 66. Thus, the rod 49 moves downwardly by the action of the spring 56' to its lowermost position causing the gripping device 78*a* to tightly or strongly grip the weft yarn 14.

Figure 5:
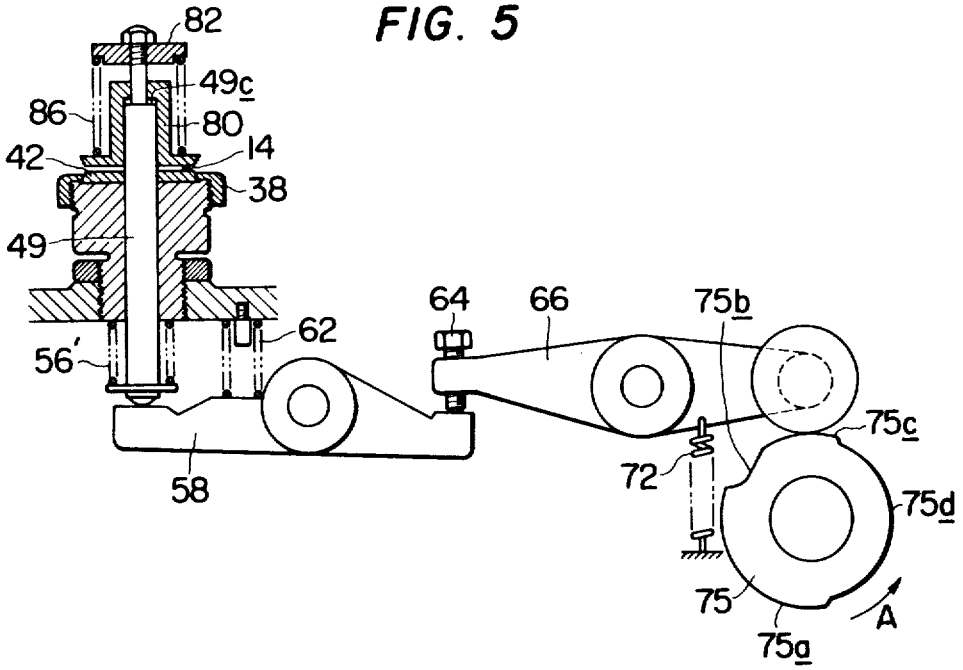

When the beating of the reed 26 is taken, the cam 75 takes a position in which the second projected cam surface 75*c* engages the cam follower 70, as seen in FIG. 5. Under this, the second lever 66 and thus the first lever 58 are moved to slightly lift up the reciprocating rod 49 thus separating the stop member 82 from the movable disc member 80. Thus, as has been described hereinbefore, the gripping force applied to the sandwiched weft yarn 14 is somewhat reduced. Now, the gripping force to the weft yarn 14 is made by only the spring 86. Accordingly, if the penetrated weft yarn 14 is subjected to a tension application which is greater than a predetermined value by the beating of the reed 26, the gripping device 78*a* permits the slippage of the weft yarn 14 therein thereby substantially cancelling the abnormal tension in the weft yarn 14. Now, it should be noted that such slippage occurs only when the magnitude of the tension exceeds the predetermined value.

After the beating of the reed 26, the cam 75 takes a position wherein the other non-projected section 75*d* engages the cam follower 70 causing the gripping device 78*a* to tightly grip the weft yarn 14.

Figure 6:
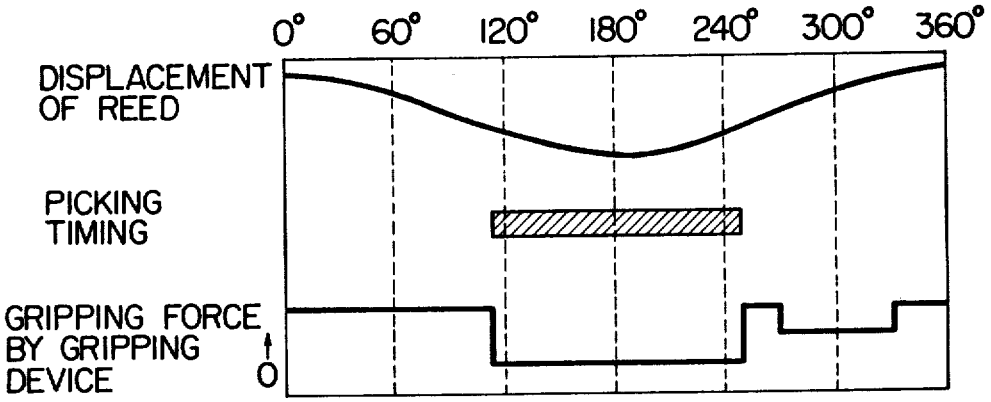
FIG. 6 is a graph showing the relationship between the zone in which picking of the weft yarn into the shed of warp yarns is possible and the gripping force applied to the weft yarn by the grasping apparatus with respect to the movement of the reed from one beat to another.

FIG. 6 shows graphically in terms of the cyclic displacement of the reed 26 from one beat up position to the next, the zone in which picking of the weft yarn 14 into the shed of warp yarns 22 is possible and the gripping force applied to the weft yarn 14 by the gripping device 78*a*.

Figure 7:
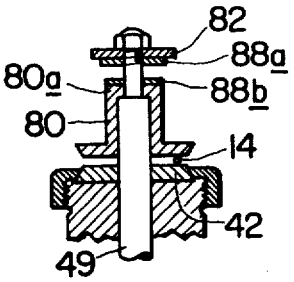
FIG. 7 is a partial sectional view showing a slight modification of the first preferred embodiment of FIG. 3.

Referring to FIG. 7, there is shown a fragmentary view of a modified form of the gripping device 78*a* according to the first embodiment. In this modification, a pair of permanent magnets 88*a* and 88*b* are employed as a substitute for the spring 86 of the gripping device 78*a*. These magnets 88*a* and 88*b* are respectively fixed to the stop member 82 and the base section 80*a* of the movable disc member 80 in such a manner that same poles thereof face each other to produce effective repulsive force between them. With this, the repulsion force produced by the magnets 88*a* and 88*b* is applied to the movable disc member 80 during the movements of it so that substantially same function as in the case of the gripping device 78*a* with the spring 86 is achieved in this modified case.

Figure 8:
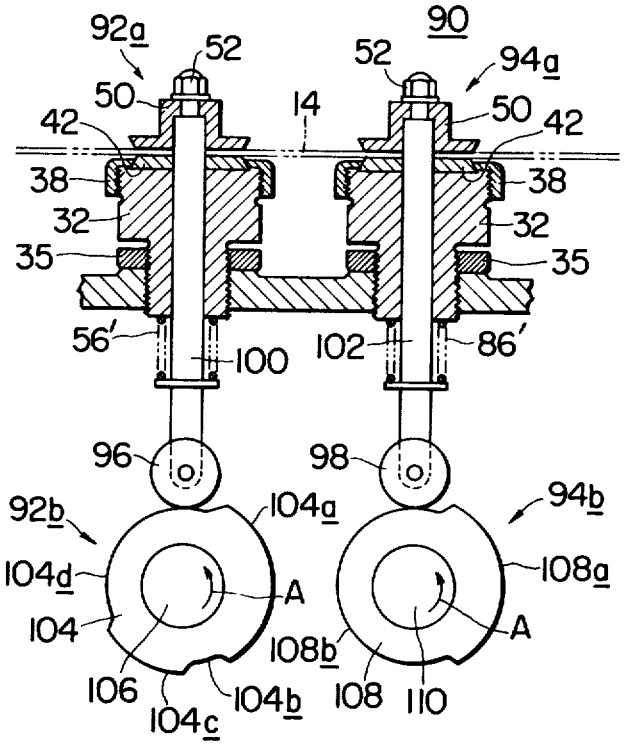
FIG. 8 is a sectional view of a weft yarn grasping apparatus of the second preferred embodiment according to the present invention.

Referring to FIG. 8, there is illustrated a second preferred embodiment of the subject invention, as being generally designated by numeral 90. The grasping apparatus 90 of this embodiment generally comprises first and second gripping devices 92*a* and 94*a* and first and second actuating devices 92*a* and 94*b*, the first and second actuating devices 92*b* and 94*b* being respectively incorporated with the first and second gripping devices 92*a* and 94*a*, as shown.

The first and second gripping device 92*a* and 94*a* are arranged in tandem with respect to the passage of the weft yarn 14. Preferably, the first gripping device 92*a* is located upstream of the second gripping device 94*a*. Each of the devices 92*a* and 94*a* comprises generally same parts as in the case of the conventional gripping device 18*a*. Thus, similar or substantially same parts are denoted by the same numerals as in the case of the conventional gripping device 18*a*. In this embodiment, however, the biasing force of the spring 86' of the second gripping device 94*a* is set sufficiently smaller than that of the spring 56' of the first gripping device 92*a*. More specifically, the springs 56' and 86' are formed to have substantially the same characteristics as the springs 56 and 86 of the first preferred embodiment shown in FIG. 3, so that the gripping force produced by the first gripping device 92*a* is considerably greater than that of the second gripping device 94*a*. For accommodation with the actuating devices 92*b* and 94*b* which will be described hereinnext, first and second cam followers 96 and 98 are rotatably fixed to lower ends of the reciprocating rods 100 and 102.

The first and second actuating devices 92*b* and 94*b* respectively have a first cam 104 firmly disposed about a first axis 106 and a second cam 108 firmly disposed about a second axis 110. These axes 106 and 110 are arranged to rotate once per one picking action, in the directions indicated by arrows A. The cam 104 of the first actuating device 92*b* is formed with first and second projected cam surface 104*a* and 104*c* which are same in height, and first and second non-projected cam surfaces 104*b* and 104*d*. The second cam 108 of the second actuating device 94*b* is formed with a projected cam surface 108*a* and a non-projected cam surface 108*b*. It should be noted, in this instance, that the first projected cam surface 104*a* of the first cam 104 and the projected cam surface 108*a* of the second cam 108 have substantially same effective length thereby to have same operation timing with respect to the weaving operation of the loom.

With the above, the operation of the grasping apparatus 90 of the second embodiment is as follows:

When the weft yarn picking is taken, the first projected cam surface 104*a* of the first cam 104 and the projected cam surface 108*a* of the second cam 108 engage their corresponding cam followers 96 and 98. Under this state, the corresponding reciprocating rods 100 and 102 and thus the movable disc members 50 and 50 are lifted to completely release the weft yarn 14. Thus, the weft yarn picking is smoothly achieved.

After the weft yarn insertion or picking, the first non-porjected cam surface 104b of the first cam 104 and the non-projected cam surface 108b of the second cam 108 engage the corresponding cam followers 96 and 98 thereby allowing the rods 100 and 102 to shift into their lowermost or home positions by the action of the springs 56' and 86'. Under this, the weft yarn 14 is gripped by the first and second gripping devices 92a and 94a. In this instance, the weft yarn gripping force applied by the second gripping device 94a is not so great in comparison with that of the first gripping device 92a because of using the relatively weak spring 86' as has been described hereinbefore.

Upon beating of the reed 26, the second projected cam surface 104c of the first cam 104 engages the first cam follower 96 while the non-projected cam surface 108b of the second cam 108 still engages the second cam follower 98. Under this, the movable disc member 50 of the first gripping device 92a is lifted to release the weft yarn 14, while the movable disc member 50 of the second gripping device 94a keeps its weft yarn gripping position. Thus, if the weft yarn 14 is abnormally pulled toward the shed of the warp yarns 22 due to the beating operation of the reed 26, a slight slippage of the weft yarn 14 is carried out in the second gripping device 94a thereby cancelling the tension of the weft yarn 14. As has been described hereinbefore, such slippage occurs only when magnitude of the tension exceeds the predetermined value.

After the beating of the reed 26, the second non-projected cam surface 104d of the first cam 104 engages the first cam follower 96 thus causing the first gripping device 92a to tightly grip the weft yarn 14.

Figure 9:
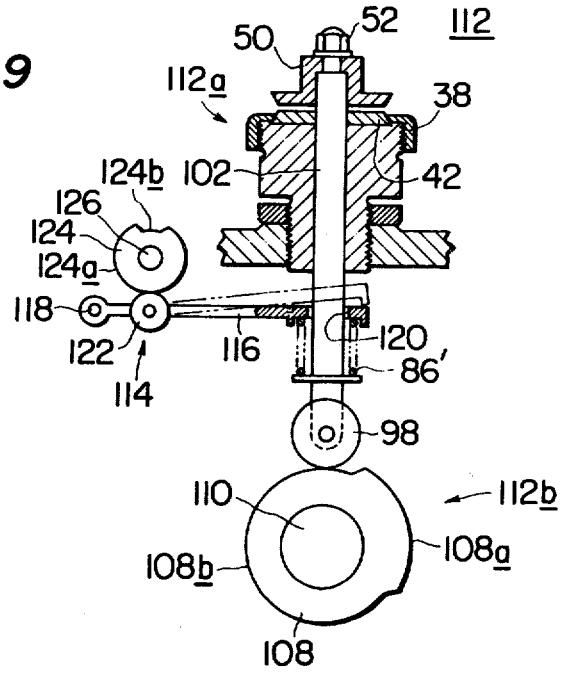
FIG. 9 is a sectional view of a weft yarn grasping apparatus of the third preferred embodiment of the invention.

In FIG. 9, a third preferred embodiment of the subject invention is shown as being designated by numeral 112. The grasping apparatus 112 of this third embodiment generally comprises a gripping device 112a and an actuating device 112b which are somewhat similar to the before-mentioned second gripping device 94a and the second actuating device 94b of the grasping apparatus 90 according to the second embodiment, except for several parts. Thus, similar or substantially same parts are denoted by the same numerals as in the case of the second embodiment 90. The gripping device 112a of the third embodiment is equipped with a bias controlling device 114 which functions to control the biasing force of the spring 86', the spring 86' being used for biasing the reciprocating rod 102 and thus the movable disc member 50 toward the cam 108. The bias controlling device 114 includes a lever 116 having an end pivotted by a fulcrum 118 and the other end which is enlarged to have an opening 120 through which the lower section of the reciprocating rod 102 is slidably passed. As shown, the other end of the lever 116 engages or holds the upper end of the spring 86' so that swingable movements of the lever 116 induce changing of the biasing force of the spring 86'. A cam follower 122 is rotatably fixed to the lever 116 at a position near the pivotted end thereof. A cam 124 having a projected cam surface 124a and a non-projected cam surface 124b is firmly disposed about an axis 126 so as to operatively engage the cam follower 122. Similar to the axis 110 for the cam 108, the axis 126 rotate one time per one picking action of the loom. It will be thus appreciated that when the projected cam surface 124a engages the cam follower 122, the lever 116 takes a position, shown by a solid line, to strongly push the spring 86' to generate a big force in the same, and when the non-projected cam surface 124b engages the cam follower 122, the lever 116 takes a position, shown by a phantom line, to softly push the spring 86' to generate a small force in the same. The cam 124 is such arranged that the engagement of the non-projected cam surface 124b with the cam follower 122 is made when the picking action takes place. Thus, under the weft yarn picking, the grasping force produced by the spring 86' is somewhat reduced even when the reciprocating rod 102 is placed in its lower most position due to the engagement of the non-projected cam surface 108b of the cam 108 with the cam follower 98, so that the weft yarn slippage occurs.

What is claimed is:

1. A weft yarn grasping apparatus for a fluid jet weaving loom having a jet nozzle for inserting a weft yarn, by the aid of a fluid jet stream, into the shed of warp yarns, said apparatus comprising:

gripping means by which said weft yarn is selectively gripped and released in response to the weaving operation of said loom; and actuating means for actuating said gripping means to take first, second and third states thereof under the picking of said weft yarn, the beating of said weft yarn and a condition other than said picking and beating, respectively, said first state being a state in which said weft yarn is completely released by said gripping means, said second state being a state in which said weft yarn is softly gripped by said gripping means such that when a predetermined magnitude of tension is applied to said weft yarn, a slippage of said weft yarn is given by said gripping means to draw out a bit of said weft yarn from said gripping means, said third state being a state in which said weft yarn is strongly gripped by said gripping means such that even when said predetermined magnitude of tension is applied to said weft yarn, the slippage of said weft yarn is prevented, said gripping means including:

movable and stationary members capable of defining therebetween a clearance in which said weft yarn is inserted, said members being respectively formed with openings which are aligned;

a rod member slidably passing through the aligned openings of said movable and stationary members and having first and second ends thereof which are outwardly projected from the respective movable and stationary members, said rod member being formed with an engaging section which is brought into contact with a portion of said movable member to move the same in a direction to increase said clearance when said rod is moved in a first direction beyond a predetermined distance;

a stop member fixed to said first end of said rod, said stop member being contactable with said movable member to move the same in a direction to decrease said clearance when said rod is moved in a second direction, said first and second directions being opposite to each other;

first biasing means for biasing said rod in said second direction; and second biasing means disposed between said movable member and said stop member for biasing said movable member in the direction to decrease said clearance, the biasing force of said second biasing means being set smaller than that of said first biasing means.

2. A weft yarn grasping apparatus as claimed in claim 1, in which each of said first and second biasing means is a spring.

3. A weft yarn grasping apparatus as claimed in claim 1, in which said second biasing means is a pair of magnets which are respectived fixed to said stop member and said movable member so as to generate repulsive force therebetween.

4. A weft yarn grasping apparatus as claimed in claim 1, in which said actuating means comprises:

a shaft, a cam member fixedly disposed about said shaft the rotation of which is synchronized with the weaving operation of said loom, said cam member being formed with first, second and third cam surfaces, and a motion transmitter having first and second end portions which are respectively contactable with said second end of said rod member and the cam surface of said cam member, the arrangement of said cam member and said transmitter being such that the engagements of said second end portion with said first, second and third cam surfaces respectively induce first, second and third conditions of said rod member, said first condition being a condition in which said rod member is moved in said first direction beyond said predetermined distance, said second condition being a condition in which said rod member is slightly moved in said first direction a distance smaller than said predetermined distance, and said third condition being a condition in which said rod member is stayed in a position wherein said stop member contacts said movable member.

5. A weft yarn grasping apparatus as claimed in claim 4, in which said first, second and third conditions of said rod member are respectively given when said picking of said weft yarn, said bearing of said weft yarn and the condition other than said picking and beating take place in said loom.

6. A weft yarn grasping apparatus for a fluid jet weaving loom having a jet nozzle for inserting a weft yarn, by the aid of a fluid jet stream, into the shed of warp yarns, said apparatus comprising:

gripping means by which said weft yarn is selectively gripped and released in response to the weaving operation of said loom, and actuating means for actuating said gripping means to take first, second and third states thereof under the picking of said weft yarn, the beating of said weft yarn and a condition other than said picking and beating, respectively, said first state being a state in which said weft yarn is completely released by said gripping means, said second state being a state in which said weft yarn is softly gripped by said gripping means such that when a predetermined magnitude of tension is applied to said weft yarn, a slippage of said weft yarn is given by said gripping means to draw out a bit of said weft yarn from said gripping means, said third state being a state of which said weft yarn is strongly gripped by said gripping means such that even when said predetermined magnitude of tension is applied to said weft yarn, the slippage of said weft yarn is prevented, said gripping means including:

first movable and stationary members capable of defining therebetween a first clearance in which said weft yarn is inserted;

second movable and stationary members capable of defining therebetween a second clearance in which said weft yarn is inserted;

a first rod member slidably passing through an opening formed in said first stationary member and having an end fixed to said first movable member and the other end which is projected outwardly from said first stationary member;

a second rod member slidably passing through an opening formed in said second stationary member and having an end fixed to said second movable member and the other end which is projected outwardly from said second stationary member;

first biasing means for biasing said first rod member and thus said first movable member in a direction to decrease said first clearance; and second biasing means for biasing said second rod member and thus said second movable member in a direction to decrease said second clearance;

the biasing force generated by said second biasing means being set smaller than that of said first biasing means, and said first and second movable and stationary members being arranged in tandem with respect to the passage of said weft yarn, said actuating means including:

a first cam member fixedly disposed about a first shaft the rotation of which is synchronized with the weaving operation of the loom, said first cam member being formed with first, second and third cam surfaces which are operatively engageable with the other end of said first rod member such that the engagement of either of said first and second cam surfaces with the other end of said first rod member induces a first condition if said first movable member in which said first clearance is increased completely releasing said weft yarn, and the engagement of said third cam surface with said the other end of said first rod members induces a second condition of said first movable member in which said first clearance is decreased gripping said weft yarn; and a second cam member fixedly disposed about a second shaft the rotation of which is synchronized with the weaving operation of the loom, said second cam member being formed with a projected cam surface and a non-projected cam surface which are operatively engageable with said the other end of said second rod member such that the engagement of said projected section with the other end of said second rod member induces a first condition of said second movable member in which said second clearance is increased releasing said weft yarn, and the engagement of non-projected cam surface with the other end of said second rod member induces a second condition of said second movable member in which said second clearance is decreased gripping said weft yarn, the engagement of said projected cam surface with said the other end of said second rod member and the engagement of said first cam surface with said the other end of said first rod member being synchronized during the weaving operation of the loom.

7. A weft yarn grasping apparatus as claimed in claim 6, in which the engagements of the other end of said first rod member with said first, second and third cam surface of said first cam member are respectively given when said picking of weft yarn, said beating of said weft yarn and other condition other than said picking and beating are carried in the loom.

8. A weft yarn grasping apparatus for a fluid jet weaving loom having a jet nozzle for inserting a weft yarn, by the aid of a fluid jet stream, into the shed of warp yarns, said apparatus comprising:

gripping means by which said weft yarn is selectively gripped and released in response to the weaving operation of said loom; and actuating means for actuating said gripping means to take first, second and third states thereof under the picking of said weft yarn, the beatng of said weft yarn and a condition other than said picking and the beating, respectively, said first state being a state in which said weft yarn is completely released by said gripping means, said second state being a state in which said weft yarn is softly gripped by said gripping means such that when a predetermined magnitude of tension is applied to said weft yarn, a slippage of said weft yarn is given by said gripping means to draw out a bit of said weft yarn from said gripping means, said third state being a state in wich said weft yarn is strongly gripped by said gripping means such that even when said predetermined magnitude of tension is applied to said weft yarn, the slippage of said weft yarn is prevented, said gripping means including:

movable and stationary members capable of defining therebetween a clearance in which said weft yarn is inserted;

a rod member slightly passing through an opening formed in said stationary member and having an end fixed to said movable member and the other end which is projected from said stationary member;

biasing means for biasing said rod member and thus said movable member in a direction to decrease said clearance; and a controller for controlling the urging force generated by said biasing means in a manner that while beating of the weft yarn takes place in the loom, the urging force of the biasing means is decreased by a predetermined value, said biasing means being a spring having one end thereof connected to a portion of said rod member near the other end of the same and the other end thereof connectable to said controller, said controller including a lever having one end pivoted and the other end connected to the other end of said spring, a cam follower rotatably fixed to said lever, and a cam member fixedly disposed about a shaft the rotation of which is synchronized with the weaving operation of the loom, said cam member being formed with a projected cam surface and a nonprojected cam surface which are operatively engageable with said cam follower in such a manner that the engagement of said projected cam surface with said cam follower induces a condition in which said spring is strongly compressed by said lever and the engagement of said non-projected cam surface with said cam follower induces a condition in which said spring is softly compressed by said lever.

9. A weft yarn grasping apparatus as claimed in claim 8, in which said actuating means comprises:

a cam member fixedly disposed about an axis the rotation of which is synchronized with the weaving operation of the loom, said cam member being formed with a projected cam surface and a non-projected cam surface which are operatively engageable with the other end of said rod member such that the engagement of said projected cam surface with the other end of said rod member induces a first condition in which said rod member is moved in a direction.

* * * * *